US011143369B2

(12) United States Patent
Sapp

(10) Patent No.: US 11,143,369 B2
(45) Date of Patent: Oct. 12, 2021

(54) CONTROLLABLE ILLUMINATION LIGHTING SYSTEM AND METHOD FOR INTERIOR OR EXTERIOR USE

(71) Applicant: Jason Westberry Sapp, Norman Park, GA (US)

(72) Inventor: Jason Westberry Sapp, Norman Park, GA (US)

( * ) Notice: Subject to any disclaimer, the term of this patent is extended or adjusted under 35 U.S.C. 154(b) by 301 days.

(21) Appl. No.: 16/602,180

(22) Filed: Aug. 23, 2019

(65) Prior Publication Data

US 2021/0054981 A1 Feb. 25, 2021

(51) Int. Cl.

| | |
|---|---|
| ***F21S 8/00*** | (2006.01) |
| ***F21S 8/04*** | (2006.01) |
| ***F21V 7/00*** | (2006.01) |
| ***F21S 8/02*** | (2006.01) |

(52) U.S. Cl.

CPC ..... *F21S 8/046* (2013.01); *F21S 8/026* (2013.01); *F21V 7/005* (2013.01)

(58) Field of Classification Search

CPC ..... F21S 8/046; F21S 8/026; F21V 7/005
See application file for complete search history.

(56) References Cited

U.S. PATENT DOCUMENTS 5,988,836 A 11/1999 Swarens
6,945,668 B1 9/2005 Orlov et al.
8,684,566 B2 4/2014 Bretschneider et al.
2007/0204551 A1* 9/2007 Izardel ..... E04B 7/105 52/639
2008/0105287 A1* 5/2008 Huali ..... A45B 3/04 135/16
2010/0296281 A1* 11/2010 Hofmann ..... F21V 7/005 362/235
2017/0292285 A1* 10/2017 Jin ..... E04H 15/60

* cited by examiner

*Primary Examiner* — Anne M Hines
(74) *Attorney, Agent, or Firm* — John D. Lee

(57) ABSTRACT

An interior or exterior indirect illumination lighting assembly is configured for mounting on a wall or ceiling. The assembly includes a longitudinally extending reflective support structure and a serially connected plurality of individual light emitting elements affixed within the reflective support structure, so that the serially connected light emitting elements are hidden from view by the reflective structural component. The serially connected plurality of individual light emitting elements may comprise a series of individually controllable lighting elements. One or more strings of these serially connected plurality of individual light emitting elements may be mounted within the support structure depending upon the total indirect illumination required or desired. The serially connected plurality of individual light emitting elements are attached to a programmable control unit to selectively control the intensity of light produced by each light emitting element, by means of which the placement of indirect illumination as well as the degree of indirect illumination can be easily monitored and controlled.

18 Claims, 9 Drawing Sheets

CONTROLLABLE ILLUMINATION LIGHTING SYSTEM AND METHOD FOR INTERIOR OR EXTERIOR USE

BACKGROUND OF THE INVENTION

(1) Field of the Invention

This invention relates generally to interior and/or exterior lighting, and more particularly to an illumination device providing indirect illumination which is controllable in intensity and area placement.

The benefits of indirect or background lighting have long been known in the art. These benefits include the even distribution of illumination, the reduction of distracting shadows, the reduction of glare and the ability to provide a soothing psychological background in both working and relaxing environments. Sometimes, however, the environment requires more or less indirect lighting than that provided by a fixed background illumination arrangement. Moreover, the environment often requires that some areas be more backlit than other areas.

There is a need, therefore, to provide an indirect lighting device which combines the benefits of indirect or background lighting with the ability to quickly and easily adjust the intensity of the background illumination, as well as the ability to quickly and easily adjust the area placement of the background illumination, and which is also relatively low in cost, aesthetically compatible with any indoor or outdoor decor, and economical to operate.

There is also a need for an indirect lighting device which, whether controllable in intensity and area placement or not, is comprised of components that are readily available, relatively low in cost, easy to assemble, and very high in energy efficiency, while at the same time being aesthetically compatible with any indoor or outdoor décor.

(2) Description of Related Art

U.S. Pat. No. 5,988,836 to Swarens and U.S. Pat. No. 8,684,566 to Bretschneider et al provide examples of prior art indirect lighting arrangements related to the present invention. These arrangements typically utilize inefficient fluorescent light tubes fixed within a reflective housing, the curved geometry of the reflective housings directing light produced by the fluorescent tube into the environment being illuminated. The curved geometry of the reflective housings also soften and expand the light being produced.

The Swarens prior art lighting fixture can provide targeted "spotlight" applications, but only to a very small area, since the fixture itself is quite small (for example, the size of a 2'×2' ceiling tile). Swarens is also limited to the use of an inefficient and unreliable fluorescent tube light source.

The Bretschneider et al lighting fixture discloses the use of luminescent material on a support structure, the luminescent material being excited by a plurality of light emitting elements such as LEDs. Designed as an alternative to conventional fluorescent tube light sources, the Bretschneider et al lighting fixture produces a great deal of heat which must be dissipated. There is no suggestion of light intensity control in this fixture, nor is there any discussion of adjustment of area placement of illumination. Moreover, because of the need to dissipate heat, the device is not economical and easy to operate.

BRIEF SUMMARY OF THE INVENTION

The present invention comprises an illumination device providing indirect illumination which is controllable in intensity and area placement, the device including a longitudinally extending reflective structural component, the component having affixed therein a plurality of individual light emitting elements connected together in a serial manner by one or more insulated electrically conductive wires. These serially connected light emitting elements are electrically powered and connected to a source of electrical power by the electrically conductive wires. The serially connected plurality of light emitting elements are provided as either a single light string or plural light strings. The reflective structural component is designed and intended to be attached to a fixed portion of the building structure which encloses the area of illumination. The serially connected light emitting elements are hidden from view by the reflective structural component, thereby providing an indirect source of illumination for the area enclosed by the building structure.

The present invention further comprises a method of providing indirect illumination which is controllable in intensity and area placement, the method including providing a longitudinally extending reflective structural component; affixing within the component a plurality of individual light emitting elements connected together in a serial manner by one or more insulated electrically conductive wires; and connecting these serially connected light emitting elements to a source of electrical power by the electrically conductive wires. In the method, the serially connected plurality of light emitting elements are provided as either a single light string or plural light strings. Also in the method, the reflective structural component is designed and intended to be attached to a fixed portion of the building structure which encloses the area of illumination, and the serially connected light emitting elements are hidden from view by the reflective structural component, thereby providing an indirect source of illumination for the area enclosed by the building structure.

The present invention further comprises an illumination device providing indirect LED illumination, the device including a longitudinally extending reflective structural component, the component having affixed therein a pair of conventional LED light tubes serially connected together by one or more insulated electrically conductive wires. These serially connected LED light tubes are electrically powered and connected to a source of electrical power by electrically conductive wires in a conventional manner. The reflective structural component is designed and intended to be attached to a fixed portion of the building structure which encloses the area of illumination. The serially connected light emitting elements are hidden from view by the reflective structural component, thereby providing an indirect source of illumination for the area enclosed by the building structure. Because conventional LED tube elements and reflective structural components are used, the relative cost of the illumination device is low, while the energy efficiency of the illumination device is very high.

The present invention still further comprises a method of providing indirect LED illumination, the method including providing a longitudinally extending reflective structural component; affixing within the component a pair of conventional LED light tubes serially connected together by one or more insulated electrically conductive wires; and connecting these serially connected LED light tubes to a source of electrical power by electrically conductive wires in a conventional manner. In the method, the reflective structural component is designed and intended to be attached to a fixed portion of the building structure which encloses the area of illumination, and the serially connected light emitting elements are hidden from view by the reflective structural component, thereby providing an indirect source of illumination for the area enclosed by the building structure.

An important aspect of the primary embodiment of the present invention, and an improvement over the prior art indirect lighting arrangements, is the ability to adjust the area placement of the background illumination. A second important aspect of the primary embodiment of the present invention, and an improvement over the prior art indirect lighting arrangements, is the ability to adjust or control the intensity of the background illumination.

Both of these important advancements over the prior art indirect lighting arrangements derive from the unique construction of the primary embodiment of the device of the present invention. The plurality of individual light emitting elements connected together in a serial manner by one or more insulated electrically conductive wires are individually and collectively adjustable. The insulated electrically conductive wires are connected to one or more programmable control units near the source of electrical power. The programmable control units have the ability to individually control the intensity of each light emitting element. Therefore, when desired or required, the intensity of some of the plurality of light emitting elements may be reduced to a zero level, resulting in no illumination in the areas associated with the zero level light emitting elements.

The indirect illumination lighting device of the present invention thus provides for full control over the intensity of illumination in all or some of the areas around which the lighting device is attached.

The present invention thus provides an indirect illumination lighting device (and associated method) of the general character described which is not subject to the disadvantages of the prior art devices discussed earlier.

A feature of the present invention is to provide an indirect illumination lighting device (and associated method) of the general character described which is relatively low in cost.

Another feature of the present invention is to provide an indirect illumination lighting device (and associated method) of the general character described which is energy efficient and economical to operate.

Another feature of the present invention is to provide an indirect illumination lighting device (and associated method) of the general character described which is ideal for use in a variety of environments, either indoors or outdoors.

Another feature of the present invention is to provide an indirect illumination lighting device (and associated method) of the general character described wherein a longitudinally extending reflective structural component has affixed therein a plurality of individual light emitting elements connected together in a serial manner by one or more insulated electrically conductive wires, the serially connected plurality of light emitting elements arranged as one or a plurality of light strings.

A further feature of the present invention is to provide an indirect illumination lighting device (and associated method) of the general character described wherein the plurality of individual light emitting elements connected together in a serial manner by one or more insulated electrically conductive wires, and arranged as one or a plurality of light strings, are hidden from view by the reflective structural component.

A still further feature of the present invention is to provide an indirect illumination lighting device (and associated method) of the general character described which provides control over the intensity of indirect illumination.

Yet another feature of the present invention is to provide an indirect illumination lighting device (and associated method) of the general character described which provides adjustment of area placement of indirect illumination.

Yet another feature of the present invention is to provide an indirect illumination lighting device (and associated method) of the general character described wherein a longitudinally extending reflective structural component has affixed therein a pair of conventional LED light tubes serially connected together by one or more insulated electrically conductive wires, the serially connected LED light tubes being electrically powered and connected to a source of electrical power by electrically conductive wires in a conventional manner.

Other aspects, features and considerations of the present invention will be obvious and will be more fully pointed out in the description which follows.

With these ends in view, the invention finds embodiment in certain combinations of elements, arrangements of parts and series of steps by which the aforesaid aspects, features and considerations and certain other aspects, features and considerations are attained, all with reference to the accompanying drawings and the scope of which will be more particularly pointed out and indicated in the appended claims.

BRIEF DESCRIPTION OF THE DRAWINGS

Other aspects and advantages of this invention will become apparent from the following more detailed description which refers to the accompanying drawings, in which.

DETAILED DESCRIPTION OF THE INVENTION

Figure 1:
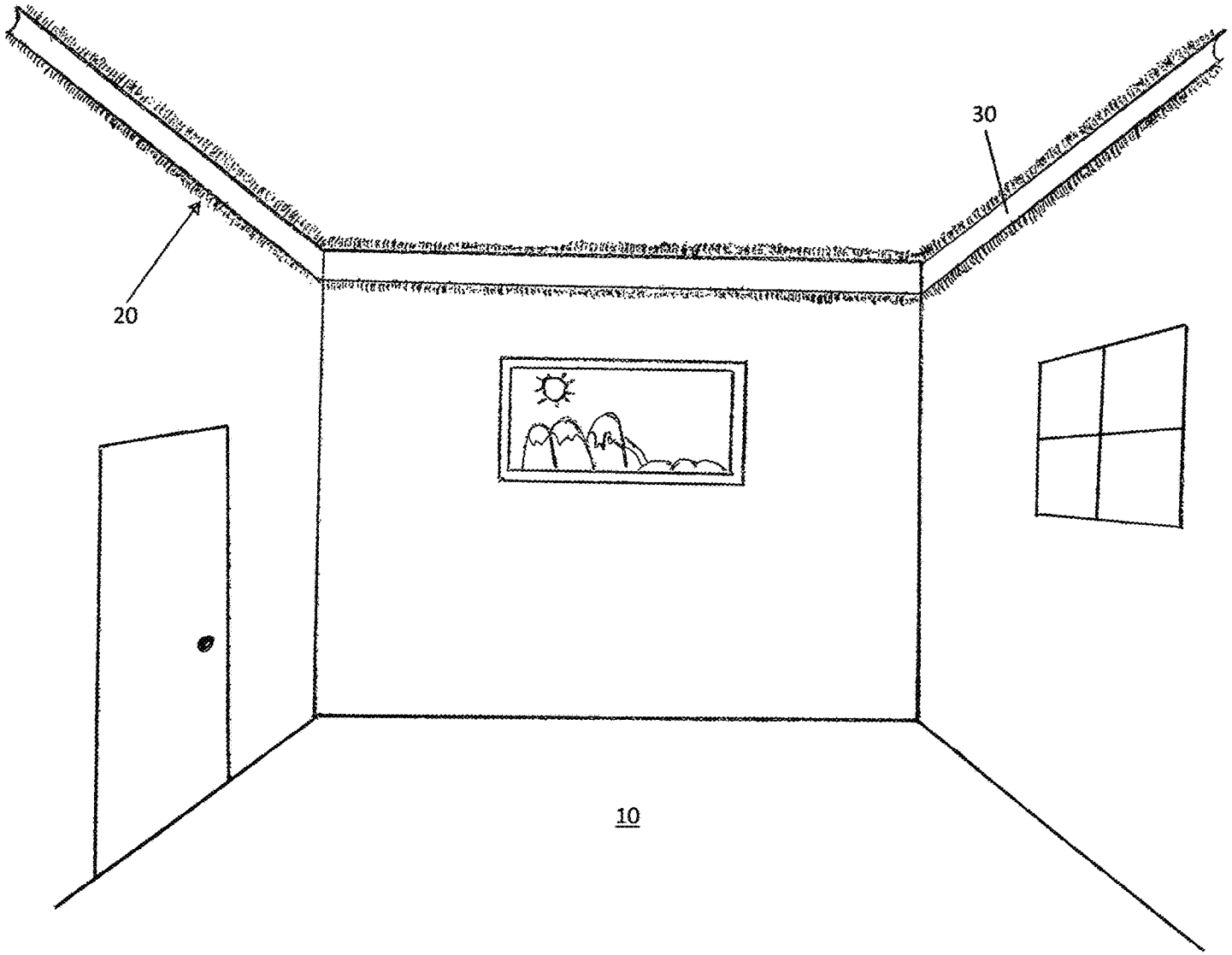
FIG. 1 is a perspective illustration of an indoor structure (a room) in which the lighting device of the present invention is utilized as a source of indirect illumination.

As illustrated in FIGS. 1-4 and 7, the reference numeral 20 denotes generally an indirect illumination lighting device in accordance with the present invention for illuminating an area enclosed by a building structure. The lighting device 20 of FIGS. 1-4 includes a reflective structural component 30 in which at least one string 40 comprising a plurality of serially connected individual light emitting elements is affixed by means of clamping elements 50. Although an indoor room is depicted in FIG. 1, the present invention is well suited for illuminating outdoor spaces as well. Such outdoor spaces include porches, patios, pavilions, and the like.

Figure 1A:
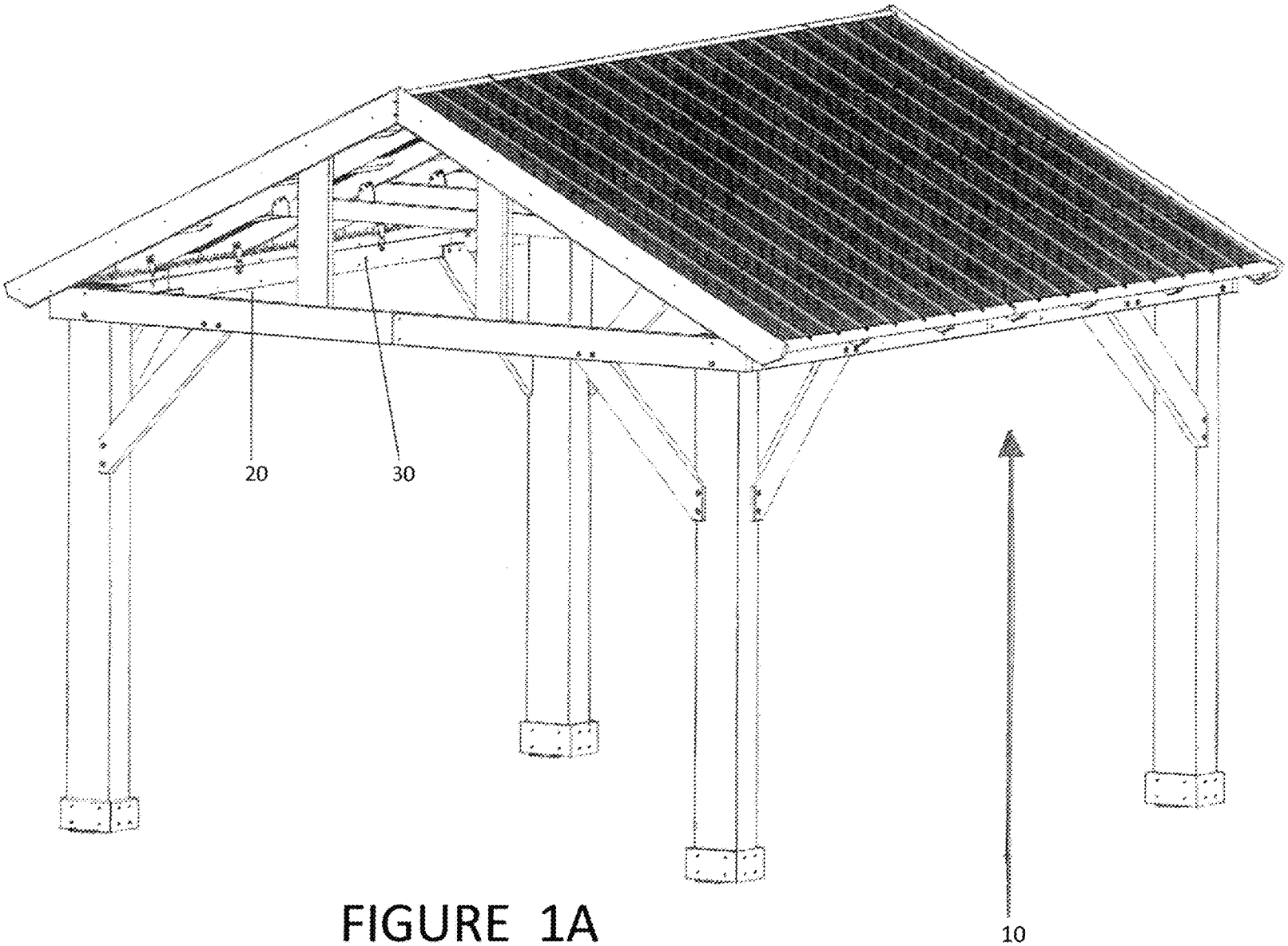
FIG. 1A is a perspective illustration of an outdoor structure (a pavilion or gazebo) in which the lighting device of the present invention is utilized as a source of indirect illumination.

In fact, FIG. 1A illustrates an outdoor space (a pavilion) which employs the indirect illumination lighting device of the present invention as the source of illumination for evening and nighttime enjoyment. The pavilion illustrated in FIG. 1A is representative of backyard outdoor entertainment venues that are very popular for get-togethers of families and friends. When indirect illumination lighting like that disclosed in the present invention is added to such a pavilion, the fun and entertainment does not have to stop when the sun goes down.

Turning to FIG. 1, room 10 represents a typical room in a home, the room 10 including a floor, a ceiling, walls, and an exterior door. Particularly during non-daylight hours, as shown in the illustration, illumination is required in order for the room space to be utilized. It has become increasingly popular to employ indirect lighting for room illumination. Accordingly, FIG. 1 illustrates an indirect illumination lighting device 20 in accordance with the present invention being employed for this purpose. The reflective structural component 30 of lighting device 20 in FIG. 1 is illustrated as being secured to the top edges of the walls of the room where the walls meet the ceiling, but in actuality any placement desired is possible.

The illumination as illustrated in FIG. 1 is sufficient to illuminate the entire room 10. However, if it is desired to illuminate only one side of room 10 or only one corner of room 10, the present invention allows for that to be accomplished. Correspondingly, if room 10 were an outdoor space (for example, a pavilion), the outdoor space may be illuminated in its entirety or in portions thereof.

FIG. 1A illustrates, in fact, a room or space 10 representing an outdoor structure having a roof but no walls or doors. The structure shown in FIG. 1A could be a pavilion or a custom built deck/gazebo having a roof overhead. Such outdoor structures are becoming increasingly commonplace, particularly in residential settings. During non-daylight hours, as shown in the illustration, illumination is required in order for the room space to be utilized. In order to preserve the aesthetics of the outdoor structure and simultaneously provide appropriate illumination, it is desirable to employ indirect lighting for illumination of all or part of the space under roof. Accordingly, FIG. 1A illustrates an indirect illumination lighting device 20 in accordance with the present invention being employed for this purpose. The reflective structural component 30 of lighting device 20 in FIG. 1A is illustrated as being secured to opposite side roof support beams of the outdoor structure, but could be secured to any solid elements of the structure.

The illumination as illustrated in FIG. 1A is sufficient to illuminate the entire space 10. However, if it is desired to illuminate only one side of space 10 or only one portion of one side of space 10, the present invention allows for that to be accomplished. Such partial illumination may be desired if one group of users is engaged in an activity wherein darkness is important (for example, the telling of scary stories or the roasting of marshmallows), while another group of users wants complete illumination at the same time for their activity.

Figure 2:
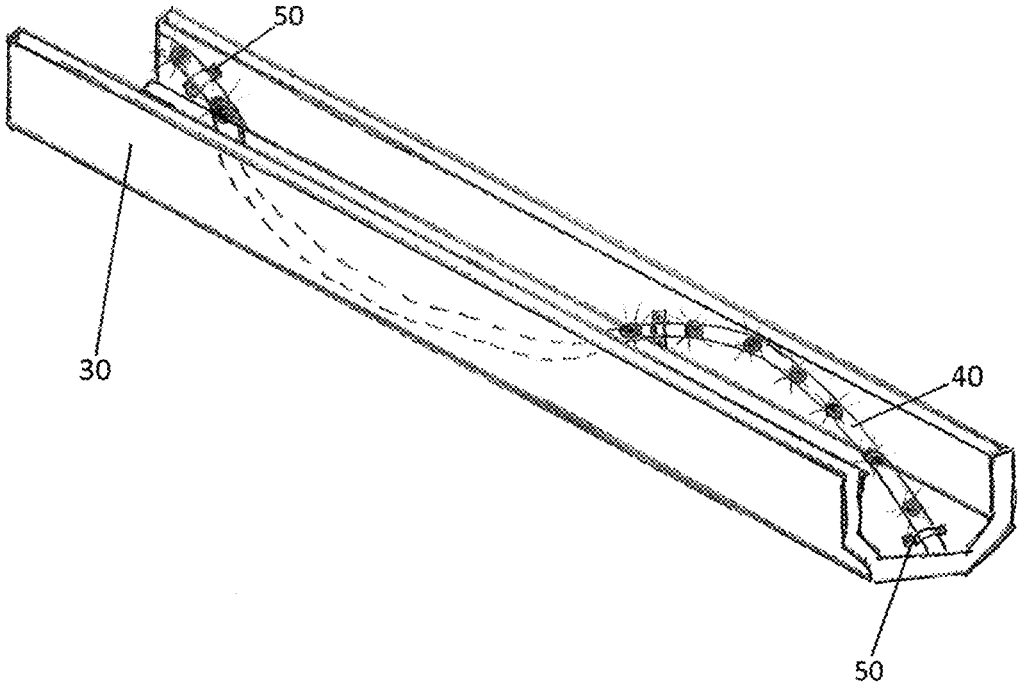
FIG. 2 is a perspective illustration of the lighting device of the present invention showing a first embodiment of serially connected light emitting elements fixed within a reflective structural component.

Turning now to FIG. 2, a first embodiment of lighting device 20 is shown, comprising a reflective structural component 30 and a string 40 comprising a plurality of serially connected individual light emitting elements affixed therein by means of clamping elements 50. In this embodiment, the reflective structural component 30 comprises a length of common rain guttering that has a bright reflective finish. While aluminum or other metal rain guttering that is highly reflective is preferred, the use of guttering made of plastic, vinyl, or other material is encompassed by the present invention, so long as the finish thereof is highly reflective. Guttering of various shapes are encompassed by the present invention. The guttering used for reflective structural component 30 in FIG. 2 is polygonal (specifically pentagonal) in cross-sectional shape, but other guttering cross-sectional shapes include, but are not limited to, L-shape, V-shape, and concave shape.

The string 40 of a plurality of serially connected individual light emitting elements as shown in FIG. 2 comprises a series of LED mini-lights enclosed in a transparent tube. As will be explained with reference to FIG. 3, the serially connected individual light emitting elements are not required to be enclosed in a tube, but such enclosure makes clamping easier. The string 40 in FIG. 2 is clamped at various locations along the length of the interior of reflective structural component 30. Two clamps 50 are illustrated in FIG. 2 for this purpose, but any number of clamps may be used in order to secure the string 40 within reflective structural component 30.

FIG. 2 shows only a single string 40 of a plurality of serially connected individual light emitting elements, but more than one string 40 may be fixed within the interior of reflective structural component 30 by additional clamps 50.

As mentioned before, the plurality of individual light emitting elements comprising each string 40 are connected together in a serial manner by one or more insulated electrically conductive wires. The wires are not visible in FIG. 2, but are contained within the transparent tube which encloses the plurality of light emitting elements. The insulated electrically conductive wires are connected to a source of electricity (not shown) and thus provide electrical power to each light emitting element. The insulated electrically conductive wires are also connected to one or more programmable control units (not shown) to individually control the intensity of light produced by each light emitting element.

The one or more strings 40 of the plurality of serially connected individual light emitting elements affixed within the interior of reflective structural component 30 are hidden from view when the lighting device 20 is in use. This is because the lighting device 20 is typically mounted to a building structure either high on a wall thereof or along a ceiling edge thereof. When in use, the interior of reflective structural component 30 reflects the light produced by each light emitting element to provide an even illumination that softly appears from behind the reflective structural component 30.

Figure 3:
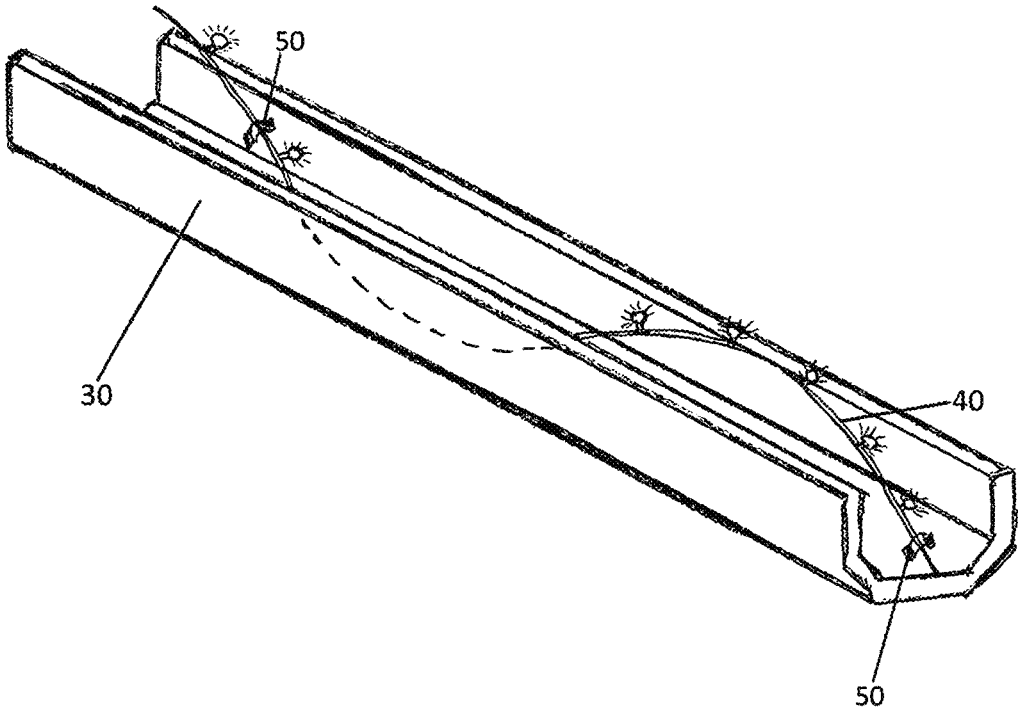
FIG. 3 is a perspective illustration of the lighting device of the present invention showing a second embodiment of serially connected light emitting elements fixed within a reflective structural component.

Turning now to FIG. 3, a second embodiment of lighting device 20 is shown, comprising a reflective structural component 30 and a string 40 comprising a plurality of serially connected individual light emitting elements affixed therein by means of clamping elements 50. In this embodiment, the plurality of serially connected individual light emitting elements comprises a series of incandescent mini-lights which are not enclosed by any tube or similar structure.

As described with respect to the FIG. 2 embodiment, the reflective structural component 30 in FIG. 3 comprises a length of common rain guttering that has a bright reflective finish. While aluminum or other metal rain guttering that is highly reflective is preferred, the use of guttering made of plastic, vinyl, or other material may also be used, so long as the finish thereof is highly reflective. Guttering of various cross-sectional shapes may be employed as discussed with respect to FIG. 2.

FIG. 3 shows only a single string 40 of a plurality of serially connected individual light emitting elements, but more than one string 40 may be fixed within the interior of reflective structural component 30 by additional clamps 50.

As mentioned before, the plurality of individual light emitting elements comprising each string 40 are connected together in a serial manner by one or more insulated electrically conductive wires. The wires are exposed (not enclosed) in the FIG. 3 embodiment. The insulated electrically conductive wires are connected to a source of electricity (not shown) and thus provide electrical power to each light emitting element. The insulated electrically conductive wires are also connected to one or more programmable control units (not shown) to individually control the intensity of light produced by each light emitting element.

The one or more strings 40 of the plurality of serially connected individual light emitting elements affixed within the interior of reflective structural component 30 are hidden from view when the lighting device 20 of FIG. 3 is in use. This is because the lighting device 20 is typically mounted to a building structure either high on a wall thereof or along a ceiling edge thereof. When in use, the interior of reflective structural component 30 reflects the light produced by each light emitting element to provide an even illumination that softly appears from behind the reflective structural component 30.

Figure 4:
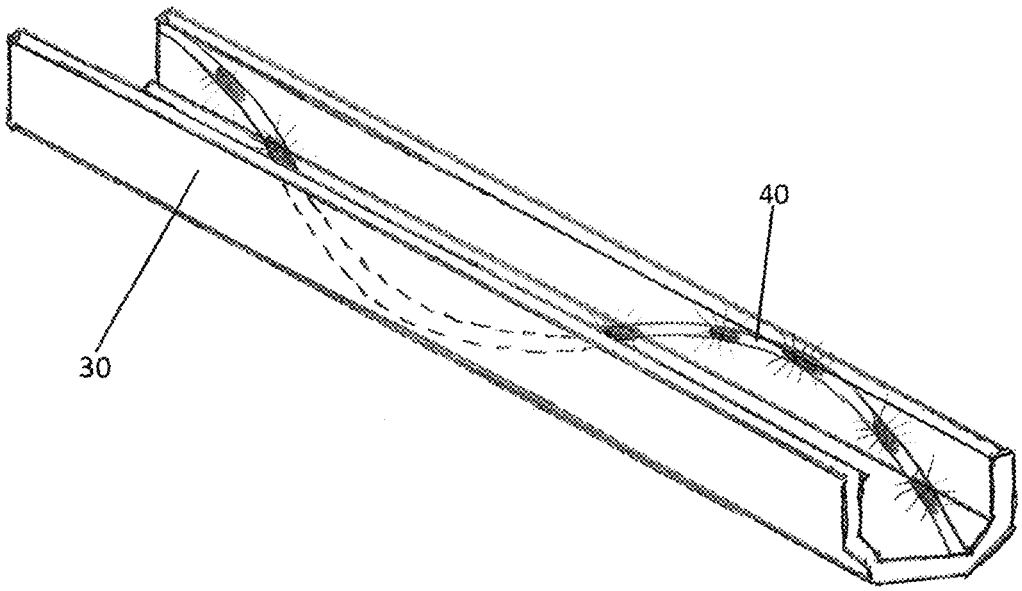
FIG. 4 is a perspective illustration of the lighting device of the present invention showing a third embodiment of serially connected light emitting elements fixed within a reflective structural component.

Turning now to FIG. 4, a third embodiment of lighting device 20 is shown, comprising a reflective structural component 30 and a string 40 comprising a plurality of serially connected individual light emitting elements disposed therein. No clamping elements are used in this embodiment, rather the string 40 is allowed to simply lie within the interior of reflective structural component 30. In this embodiment, the plurality of serially connected individual light emitting elements comprises a series of either LED mini-lights or incandescent mini-lights which are enclosed by a transparent tube.

As described with respect to the FIG. 2 and FIG. 3 embodiments, the reflective structural component 30 in FIG. 4 comprises a length of common rain guttering that has a bright reflective finish. While aluminum or other metal rain guttering that is highly reflective is preferred, the use of guttering made of plastic, vinyl, or other material may also be used, so long as the finish thereof is highly reflective. Guttering of various cross-sectional shapes may be employed as discussed with respect to FIG. 2.

FIG. 4 shows only a single string 40 of a plurality of serially connected individual light emitting elements enclosed by a transparent tube, but more than one string 40 may be placed within the interior of reflective structural component 30.

As mentioned before, the plurality of individual light emitting elements comprising each string 40 are connected together in a serial manner by one or more insulated electrically conductive wires. The wires are not visible in FIG. 4, but are contained within the transparent tube which encloses the plurality of light emitting elements. The insulated electrically conductive wires are connected to a source of electricity (not shown) and thus provide electrical power to each light emitting element. The insulated electrically conductive wires are also connected to one or more programmable control units (not shown) to individually control the intensity of light produced by each light emitting element.

The one or more strings 40 of the plurality of serially connected individual light emitting elements affixed within the interior of reflective structural component 30 are hidden from view when the lighting device 20 of FIG. 4 is in use. This is because the lighting device 20 is typically mounted to a building structure either high on a wall thereof or along a ceiling edge thereof. When in use, the interior of reflective structural component 30 reflects the light produced by each activated light emitting element to provide an illumination that softly appears from behind the reflective structural component 30.

Figure 5:
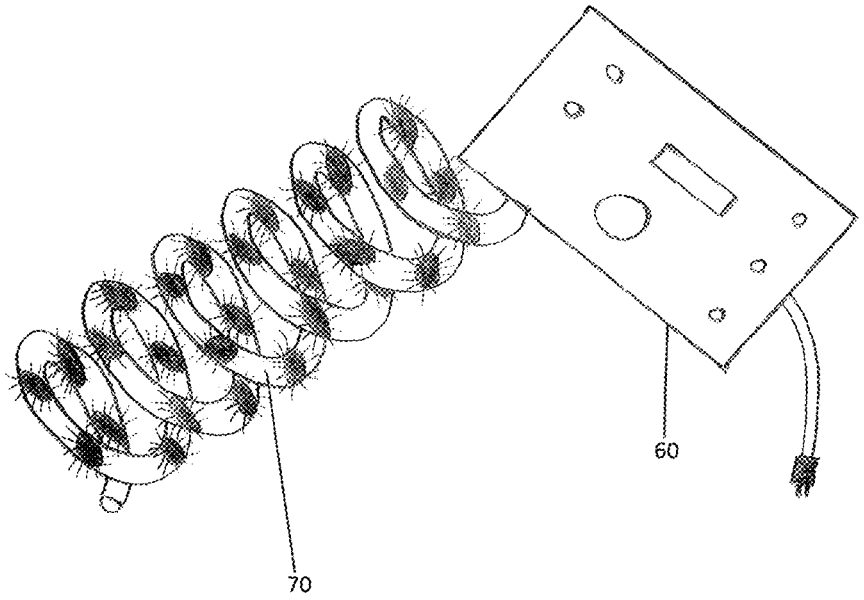
FIG. 5 is a perspective view of a coiled string of serially connected light emitting elements connected to a programmable control unit.

FIG. 5 shows a coiled double string 70 of serially connected light emitting elements, each string having its serially connected light emitting elements enclosed in a transparent tube. When uncoiled, stretched lengthwise, and placed in the interior of a longitudinally extending reflective structural component like the components 30 of FIGS. 2, 3, and 4, the double string 70 and the reflective structural component become the primary elements of an indirect illumination lighting device of the present invention. FIG. 5 also shows a programmable control unit 60 to which the insulated electrically conductive wires of the double string 70 are connected.

The programmable control unit 60 is not shown in detail in the drawings, but its functionality is well understood by those ordinarily skilled in the art. Programmable control unit 60 utilizes well known technology to selectively dim individual light emitting elements of lighting device 20. Dimmable incandescent light bulbs and dimmable LEDs (as well as strings thereof) are readily available at economical costs. Dimmable incandescent light bulbs, of course, operate on the principle of increasing or decreasing the voltage supplied thereto. Dimmable LEDs, on the other hand, operate on the principle of pulse-width-modulation, wherein the "on-cycles" and "off-cycles" of the electrical signals supplied to the LEDs are adjusted. For example, for an LED light element dimmed to 50% brightness, the "on-cycle" occupies half of the supplied pulse. For a low lighting effect of just 10% brightness, the "on-cycle" occupies only 10% of the supplied pulse.

All of the above described control for the selective dimming and/or brightening of individual light emitting elements is accomplished within the programmable control unit 60 in accordance with well known electronic control principles. No further discussion of the individual components of programmable control unit 60 is thus required for the purposes of the present invention. In the present invention, each light emitting element of each string is therefore controllable in its light intensity. This allows for any portion or section of the lighting device 20 described herein to be illuminated at any desired level of light intensity.

Figure 6:
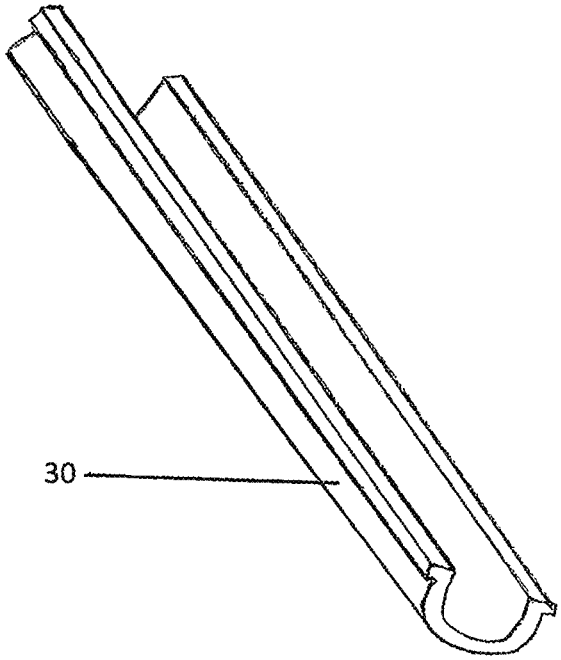
FIG. 6 is a perspective view of a concave shaped reflective structural component which can be used in the present invention.

FIG. 6 illustrates an alternative form of the reflective structural component 30 described above with respect to the embodiments of FIGS. 2, 3, and 4. As indicated in the discussions of these embodiments, the reflective structural component 30 preferably comprises a length of common rain guttering that has a bright reflective finish. As indicated in those discussions, while aluminum or other metal rain guttering that is highly reflective is preferred, the use of guttering made of plastic, vinyl, or other material can be used as well, so long as the finish thereof is highly reflective. Further as indicated in those discussions, guttering of various shapes, including a concave shape, can be used. FIG. 6 thus shows a concave, highly reflective, aluminum rain gutter that can be used as structural component 30 in any of the FIGS. 2, 3, and 4 embodiments.

Figure 7:
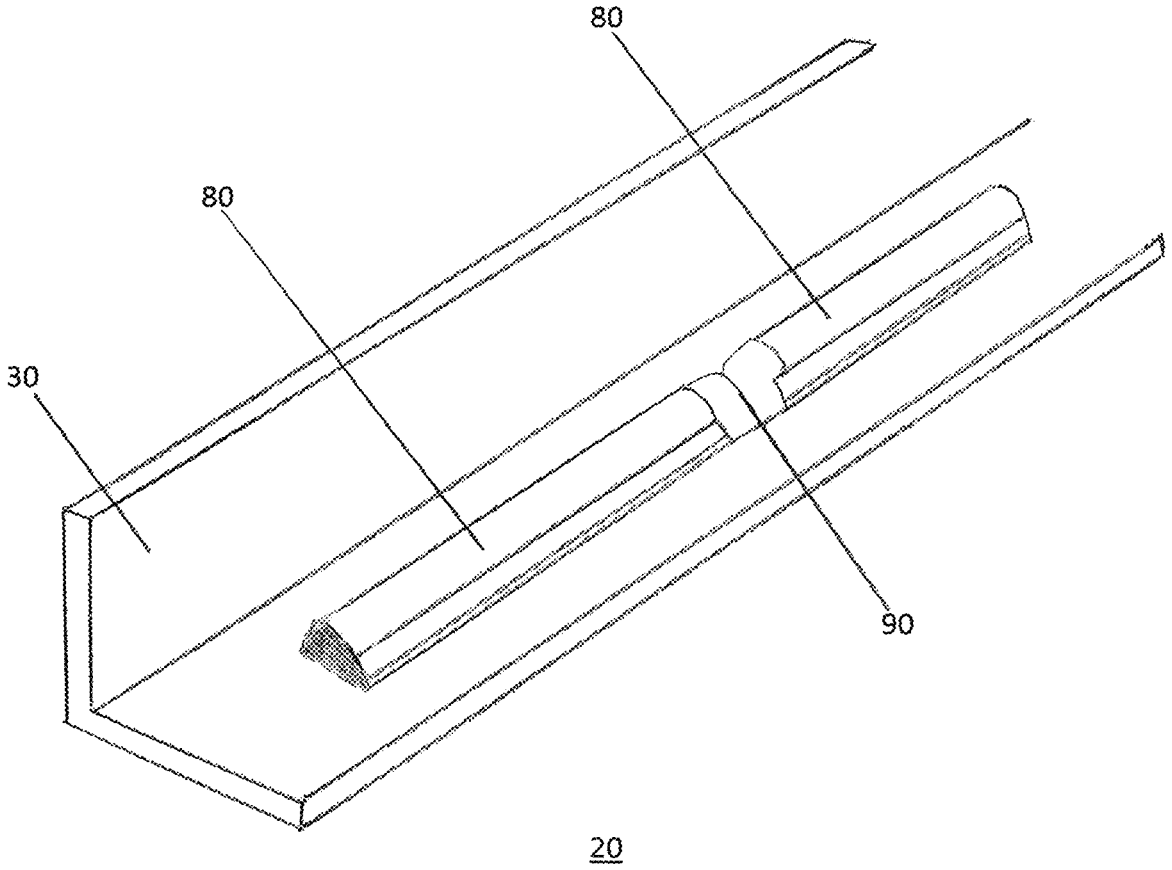
FIG. 7 is a perspective illustration of the lighting device of the present invention showing a fourth embodiment of two serially connected LED light emitting tubes fixed within a reflective structural component.

FIG. 7 illustrates a fourth embodiment of the present invention, wherein a reflective structural component 30 has secured therein a pair of conventional LED light tubes 80 serially connected together by one or more insulated electrically conductive wires. The serial connection of the pair of LED light tubes 80 is indicated by numeral 90 in the Figure. The serially connected LED light tubes are electrically powered and connected to a source of electrical power by electrically conductive wires in a conventional manner.

LED light tubes are employed in this embodiment of the invention for a variety of reasons. First of all, such tubes have become commonly available and affordable as costs have decreased in recent years. Secondly, they are available in standard four foot lengths which are ideal for use in this embodiment of the present invention. When two LED light tubes 80 are connected end-to-end within a reflective structural component 30 as shown in FIG. 7, an eight foot long module of the lighting device 20 is created, which is an ideal modular size for attachment to the walls or ceiling of the outdoor structure 10 shown in FIG. 1A. Thirdly, the lifetimes of LED lighting components, including LED light tubes 80, are extremely long (upwards of 25,000 hours of continuous usage). This means that the modules attached to the outdoor structure 10 will not have to be replaced for a long, long time.

Figure 8:
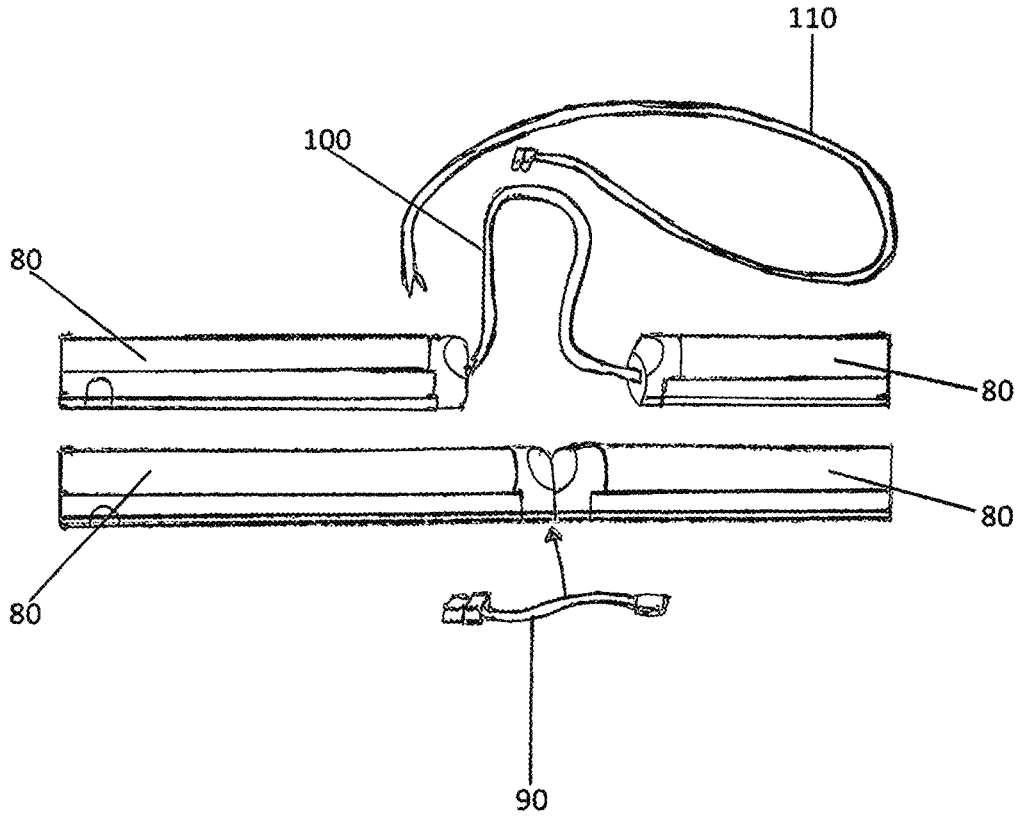
FIG. 8 is a detailed perspective view of the connection of the two serially connected LED light emitting tubes of FIG. 7.

As already mentioned, the pair of conventional LED light tubes 80 in FIG. 7 are serially connected together by one or more insulated electrically conductive wires. Such wired connectors are also known in the art as "jumpers" or "whips". FIG. 8 provides a close-up view of the serial connection of two LED light tubes 80 using such whips.

In FIG. 8 it can be seen that any whip used for connection is formed with modular connectors on both ends, the whip modular connectors plugging into appropriately formed modular receptacles on the LED light tubes 80. Either a short whip 90 or a longer whip 100 can be used, depending upon the spacing desired between the pair of LED light tubes 80. A power whip 110 is used in conjunction with whatever connector whip is used, the power whip 110 connecting to incoming line voltage for supplying the serially connected pair of LED light tubes 80 with electrical power.

Returning to FIG. 7, attention is drawn to the reflective structural component 30 of the lighting device 20. It was discussed earlier that g uttering of various shapes are encompassed by the present invention. The guttering used for reflective structural component 30 in FIG. 7 is L-shaped, which is a very convenient shape and one of the alternative shapes mentioned before. Like the previous embodiments, however, guttering of various shapes can be used for the reflective structural component 30 of the lighting device 20.

It is apparent from the above detailed description that the present invention provides an improvement over the prior art indirect lighting arrangements, particularly because of the invention's ability to adjust the area placement of the background illumination and because of the invention's ability to adjust or control the intensity of the background illumination.

The present invention provides a high quality indirect lighting arrangement that can easily be attached to any building structure and thus is suitable for either indoor or outdoor applications.

The present invention also provides a high quality indirect lighting arrangement that, because of the ordinary materials used in its construction, is relatively low in cost.

The present invention further provides a high quality indirect lighting arrangement that is energy efficient and economical to operate.

Since various possible embodiments might be made of the present invention and since various changes might be made in the exemplary embodiments shown herein without departing from the spirit of the invention, it should be understood that all matter herein described or shown in the accompanying drawings is to be interpreted as illustrative and not in a limiting sense.

The embodiments of the invention in which an exclusive property or privilege is claimed are defined in the following claims.

The invention claimed is:

1. An indirect illumination lighting device for illuminating an area enclosed by a building structure, comprising: a longitudinally extending reflective structural component, the component having affixed therein a plurality of individual light emitting elements connected together in a serial manner by one or more insulated electrically conductive wires, the serially connected light emitting elements being electrically powered and connected to a source of electrical power by the electrically conductive wires, the reflective structural component being attached to a fixed portion of the building structure enclosing the area of illumination, wherein: the serially connected light emitting elements are hidden from view by the reflective structural component, thereby providing an indirect source of illumination for the area enclosed by the building structure.

2. An indirect illumination lighting device as set forth in claim 1, wherein a plurality of strings of light are affixed within the reflective structural component, each of the strings of light comprising a plurality of individual light emitting elements connected together in a serial manner by one or more insulated electrically conductive wires.

3. An indirect illumination lighting device as set forth in claim 2, wherein all of the plurality of strings of light are connected to a programmable control unit to selectively control the intensity of light produced by each light emitting element of the device.

4. An indirect illumination lighting device as set forth in claim 1, wherein the plurality of individual light emitting elements connected together in a serial manner by one or more insulated electrically conductive wires are connected to a programmable control unit to selectively control the intensity of light produced by each light emitting element.

5. An indirect illumination lighting device as set forth in claim 1, wherein the longitudinally extending reflective structural component comprises guttering.

6. An indirect illumination lighting device as set forth in claim 1, wherein the serially connected light emitting elements comprise a string of spaced incandescent light sources.

7. An indirect illumination lighting device as set forth in claim 6, wherein the string of spaced incandescent light sources are enclosed in a tube.

8. An indirect illumination lighting device as set forth in claim 1, wherein the serially connected light emitting elements comprise a string of spaced light emitting diodes.

9. An indirect illumination lighting device as set forth in claim 8, wherein the string of spaced light emitting diodes are enclosed in a tube.

10. A method of providing indirect illumination lighting for an area enclosed by a building structure, the method comprising the steps of:

a) providing a longitudinally extending reflective structural component;

b) affixing a plurality of individual light emitting elements within the longitudinally extending reflective structural component, so that the plurality of individual light emitting elements are connected together in a serial manner by one or more insulated electrically conductive wires;

c) connecting the serially connected light emitting elements to a source of electrical power by the electrically conductive wires; and d) attaching the structural component and the serially connected light emitting elements affixed therein to a fixed portion of the building structure enclosing the area of illumination, wherein the serially connected light emitting elements are hidden from view by the reflective structural component, thereby providing an indirect source of illumination for the area enclosed by the building structure.

11. A method as set forth in claim 10, wherein the step of affixing comprises affixing a plurality of strings of light within the reflective structural component, each of the strings of light comprising a plurality of individual light emitting elements connected together in a serial manner by one or more insulated electrically conductive wires.

12. A method as set forth in claim 11, comprising the further step of e) connecting all of the plurality of strings of light to a programmable control unit to selectively control the intensity of light produced by each light emitting element of the device.

13. A method as set forth in claim 10, comprising the further step of e) connecting the plurality of individual light emitting elements connected together in a serial manner by one or more insulated electrically conductive wires to a programmable control unit to selectively control the intensity of light produced by each light emitting element.

14. A method as set forth in claim 10, wherein the longitudinally extending reflective structural component comprises guttering.

15. A method as set forth in claim 10, wherein the serially connected light emitting elements comprise a string of spaced incandescent light sources.

16. A method as set forth in claim 15, wherein the string of spaced incandescent light sources are enclosed in a tube.

17. A method as set forth in claim 10, wherein the serially connected light emitting elements comprise a string of spaced light emitting diodes.

18. A method as set forth in claim 17, wherein the string of spaced light emitting diodes are enclosed in a tube.

* * * * *